US007358486B1

(12) United States Patent
Han

(10) Patent No.: US 7,358,486 B1
(45) Date of Patent: Apr. 15, 2008

(54) CLEANING AND RECONDITIONING OF AN INLINE AUTOMATED CHEMICAL ANALYSIS SYSTEM

(75) Inventor: Ye Han, San Jose, CA (US)

(73) Assignee: Metara, Inc., Sunnyvale, CA (US)

( * ) Notice: Subject to any disclaimer, the term of this patent is extended or adjusted under 35 U.S.C. 154(b) by 0 days.

(21) Appl. No.: 11/323,081

(22) Filed: Dec. 30, 2005

(51) Int. Cl.
*H01J 49/04* (2006.01)

(52) U.S. Cl. ..... 250/282; 250/288; 210/638

(58) Field of Classification Search ..... None
See application file for complete search history.

(56) References Cited

U.S. PATENT DOCUMENTS 6,558,946 B1 * 5/2003 Krishnamurthy ..... 435/288.6
6,813,568 B2 * 11/2004 Powell et al. ..... 702/31
6,878,932 B1 * 4/2005 Kroska ..... 250/288

* cited by examiner

*Primary Examiner*—Jack I. Berman
*Assistant Examiner*—Zia R. Hashmi
(74) *Attorney, Agent, or Firm*—Jonathan W. Hallman; MacPherson Kwok Chen & Heid LLP

(57) ABSTRACT

A method, system, and mixture for simultaneously cleaning and reconditioning at least a part of a sampling pathway of an inline automated mass spectrometry system are disclosed. A sampling pathway including a probe or a nebulizer, in one example, may be simultaneously reconditioned and cleaned by mixing an isotopically enriched species and/or natural abundant species with a cleaning solution, and then cleaning the sampling pathway with the spiked cleaning solution through various means and procedures.

31 Claims, 2 Drawing Sheets

CLEANING AND RECONDITIONING OF AN INLINE AUTOMATED CHEMICAL ANALYSIS SYSTEM

TECHNICAL FIELD

The present invention relates generally to chemical analysis and, more particularly, to apparatus and methods for cleaning and reconditioning of an inline and automated chemical analysis system.

BACKGROUND

Mass spectrometers and other systems are used for measurement of the concentration of analytes or the detection and measurement of contaminants and trace additives in solutions and gases. As one example in the field of semiconductor processing, process solutions for wafer cleaning, etching and other forms of surface preparation are routinely analyzed using mass spectrometers with plasma ionization sources, one type is an inductively coupled plasma mass spectrometer (ICP-MS). The measurements made by ICP-MS are used to determine and manage the quality of process solutions. Ultrapure water (UPW), dilute hydrofluoric acid (HF), and standard industry clean formulations SC1 (Standard Clean 1, ammonium hydroxide and hydrogen peroxide in water) and SC2 (hydrochloric acid and hydrogen peroxide in water) are examples of solutions that are routinely analyzed. Quick and accurate analysis in these and other industrial process solutions can result in the early detection of contamination problems, better control of process chemistry, and ultimately lead to higher yields and less product variation. It is noted that the application of the method and apparatus described herein is not limited to industrial process control solutions but is applicable to use in life sciences, environmental and other applications as well.

Mass spectrometry is often the technique of choice to achieve sensitivity for trace and ultra-trace analysis in which the analyte concentration may be as small as parts per billion (ppb) or sub-ppb such as parts per trillion (ppt). For example, commonly assigned U.S. patent application Ser. Nos. 10/086,025, now U.S. Pat. No. 7,220,383, and 10/094,394 disclose automated analytical apparatuses that measure contaminants or constituents present in trace concentrations, the full disclosures of which are hereby incorporated by reference for all purposes. As disclosed in these applications, a sample is extracted having an analyte to be characterized. The extracted sample is spiked with a spike related to the analyte. For example, the spike may be an isotopically-altered version of the analyte as practiced in isotope dilution analysis or the spike may be a chemical homologue of the analyte as practiced in an internal standard analysis. The sample/spike mixture is then ionized and its mass spectrum determined in a mass spectrometer. The responses of the analyte and the spike in the mass spectrum enable a ratio measurement to be performed to, for example, characterize a concentration of the analyte in the extracted sample.

In another example, commonly-assigned U.S. patent application Ser. No. 10/004,627, now U.S. Pat. No. 6,974,951, which is incorporated by reference in its entirety, discloses an automated analytical apparatus for measuring contaminants or constituents present in trace concentrations using In Process Mass Spectrometry (IPMS) and an electrospray ionization source. In the IPMS technique, a sample of interest is spiked with a known amount of an appropriate isotopically enriched species and/or natural abundant species. This spike is to be used as an internal standard during the mass spectrometry measurement. In this technique, the relative ratios of peak areas present in the mass spectra of the sample species of interest and the isotopically enriched species and/or natural abundant species are used to determine the concentration of the chemical constituents of interest in the sample.

Sensitivities for trace constituents including organic species, molecules and trace metals such as Cu, Cr, Zn, Ni, and Co down to a one part per trillion (ppt) and beyond are potentially possible. UPW, HF, SC1, SC2, and other semiconductor process chemistries can be analyzed. Constituent concentration or contamination levels can be quantified through IPMS or other suitable methods. In one embodiment, IPMS combines the sample with an isotopically enriched calibrated spike. The spike serves as the calibration reference for determining the analytes by comparing relative ratios.

Trace contaminant metrology (TCM) and chemical composition metrology (CCM) tools, both available from Metara Inc. of Sunnyvale, Calif., rely on an electrospray ionization time-of-flight mass spectrometer (ESI TOF MS) for the measurement and quantitation of analytes. With continued sampling and analysis, contaminants and residue (e.g., silica) from the samples and/or solutions used in the process (e.g., SC1) may accumulate in the sampling and analysis pathway, in particular reducing or blocking the flow through the electrospray probe and/or sampling tube, causing inaccuracy, lower resolution, and/or lower sensitivity for the measurements. In order to acquire high resolution data with high sensitivity, a clean and well-maintained mass spectrometer system is needed.

Furthermore, the performance and efficiency of electrospray and other ionization techniques are often affected by the surface condition of the ionization apparatus. Optimum and stable operation of the ion source requires that the surfaces of the ionization apparatus are "conditioned" to a state where they are in equilibrium with the process solution that is being analyzed. Reconditioning is the process by which this state is induced in the shortest possible time.

Accordingly, apparatus and methods for cleaning and reconditioning of inline and automated chemical analysis systems are highly desirable to improve accuracy, precision, and efficiency.

SUMMARY

A method, apparatus, and mixture for simultaneously cleaning and reconditioning a sampling pathway of an inline automated mass spectrometry system are disclosed. A sampling pathway with an electrospray probe or nebulizer may be simultaneously cleaned and reconditioned by mixing isotopically enriched species and/or natural abundance species with a cleaning solution, and then cleaning the pathway (in one example including the probe or nebulizer) with the spiked cleaning solution through various advantageous means and procedures.

In accordance with one embodiment of the present invention, a method for cleaning and reconditioning an inline electrospray ionization mass spectrometer is provided, the method comprising providing a mixture of a spike or other appropriate substance and a cleaning solution, and cleaning a sampling pathway with the mixture. In one example, the sampling pathway may include a probe or a nebulizer.

In accordance with another embodiment of the present invention, a method for automatically reconditioning and cleaning a sampling pathway and an electrospray probe of an inline electrospray ionization mass spectrometer apparatus is provided, the method comprising providing a mixture of a spike or other suitable substance and an electrospray cleaning solution; switching on an electrospray voltage; switching off a nebulizer gas; cleaning the electrospray probe with the mixture; guiding the used mixture to a drain; and flowing a spiked sample after cleaning the electrospray probe with the mixture.

In accordance with yet another embodiment of the present invention, a system for analyzing a chemical solution or gas is provided, the system comprising a reservoir holding a mixture of a cleaning solution and a spike or other suitable substance; a sample delivery system; a spray chamber, wherein a gas or a liquid can be introduced; a probe operably coupled to the spray chamber; and a mass spectrometer coupled to the probe.

In accordance with yet another embodiment of the present invention, a mass spectrometer cleaning and reconditioning mixture is provided, the mixture comprising a cleaning solution, and a spike, wherein the mixture is used to clean and recondition an electrospray probe or a nebulizer.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

Figure 1:
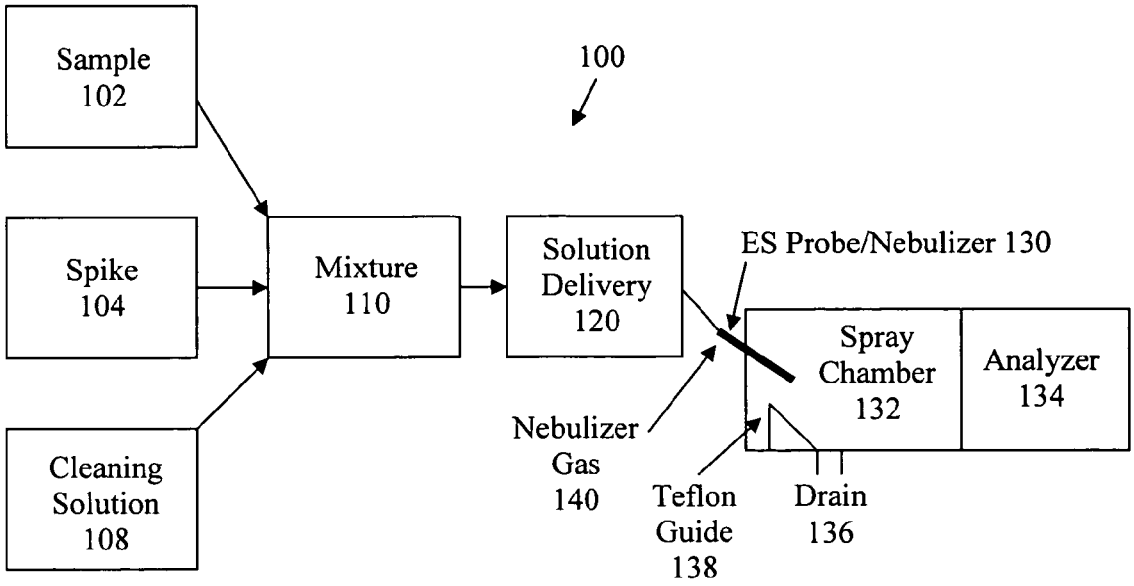
FIG. 1 shows a system for cleaning and reconditioning of a system for analyzing gases and chemical solutions in accordance with one embodiment of the present invention.

Embodiments of the present invention and their advantages are best understood by referring to the detailed description that follows. It should be appreciated that like reference numerals are used to identify like elements illustrated in one or more of the figures. It should also be appreciated that the figures may not be necessarily drawn to scale.

DETAILED DESCRIPTION

The present invention provides apparatus and methods for improved inline and automated chemical analysis, in particular providing a system, method, and mixture for cleaning and reconditioning a sampling pathway with an electrospray probe or nebulizer of an inline and automated mass spectroscopy system.

FIG. 1 shows a system 100 for cleaning and reconditioning in accordance with one embodiment of the present invention. System 100 includes a sample source 102, a spike source 104, a cleaning solution source 108, a mixture reservoir 110, a solution delivery apparatus 120 (e.g., tube and/or a syringe), an electrospray (ES) probe or nebulizer 130, a spray chamber 132, and an analyzer/ion detection module 134. In one example, spray chamber 132 includes a Teflon guide 138 for draining spent cleaning solution to a drain 136. In a further example, a nebulizer gas source 140 is operably coupled to ES probe/nebulizer 130.

ES probe or nebulizer 130 directs nebulized liquid into sample introduction or spray chamber 132, in one example at atmospheric pressures. The nebulized liquid is drawn from a sample 102 of solution to be analyzed, such as a SC2 or UPW bath. The nebulized aerosol is formed by combining a carrier gas, such as argon, helium, or nitrogen, with the analyte to form a spray.

Previously, cleaning of the electrospray probe and sampling tube has been accomplished with solutions including but not limited to UPW, dilute HF (e.g., 1% HF), ammonia, methanol, and/or dilute nitric acid (e.g., 1% nitric acid). It has been discovered that sensitivity towards the spiked isotopically enriched species and/or natural abundant species in IPMS processing of samples is lowered and/or shifted after cleaning. It is believed that a cleaning process may shift an equilibrium established between the inner surface of the electrospray probe and spiked samples.

In accordance with the present invention, all or a portion of the sample pathway (in one example including the ES probe or nebulizer 130) may be simultaneously reconditioned and cleaned by combining/mixing a spike (e.g., cation species, anion species, molecular species, isotopically enriched species, and/or natural abundant species; such as bis (2-sulfoethyl) disulfide (SES), $^{65}Cu^{2+}$, $Cl^-$, or $^{13}C$-enriched isopropyl alcohol) with a cleaning solution (including but not limited to ultrapure water, acids, bases, organic solvents or chelating reagents; such as hydrofluoric acid, nitric acid, acetic acid, ammonium hydroxide, methanol, or EDTA), and then cleaning the probe, nebulizer, and/or sampling pathway with the spiked cleaning solution. For example, when dilute HF with isotopically enriched species and/or natural abundant species passes through the ES probe, the dilute HF cleans/dissolves silicon-related deposits on the probe while the added spike maintains the spike concentration equilibrium for the ES probe, such that after the cleaning step, the next sample (with spike) for analysis does not need to be delayed by the need for a separate conditioning step that is required to restore spike concentration equilibrium between the probe and spiked sample. Thus, the present invention conditions the needle to give optimum response for the analyte to be subsequently measured after the cleaning.

In one example, the spike is one of cation species, anion species, molecular species, isotopically enriched species and/or natural abundant species, and in a further example, the spike is one of bis (2-sulfoethyl) disulfide (SES), $^{65}Cu^{2+}$, $Cl^-$, $^{13}C$-enriched isopropyl alcohol, and/or mixtures thereof. In yet another example, the isotopically enriched species and/or natural abundant species may be the same or different as the spike to be used in the sampling after the cleaning process. When different, the spike used for cleaning/reconditioning may be higher or lower in concentration than the spike to be used for the subsequent measurement of analytes. For example, in the case of measuring trace elemental contaminants in semiconductor clean solution 1 (SC1), to clean the Si species deposited in the sampling path and probe, the spiked cleaning solution may include between about 0.2%-2% HF spiked with between about 0.2 ppb-10 ppb isotopically-enriched elemental species, such as $^{25}Mg$, $^{41}K$, Ni, $^{136}Ba$, and $^{206}Pb$, and natural abundant species, such as Al, Mn, and Co.

Figure 2:
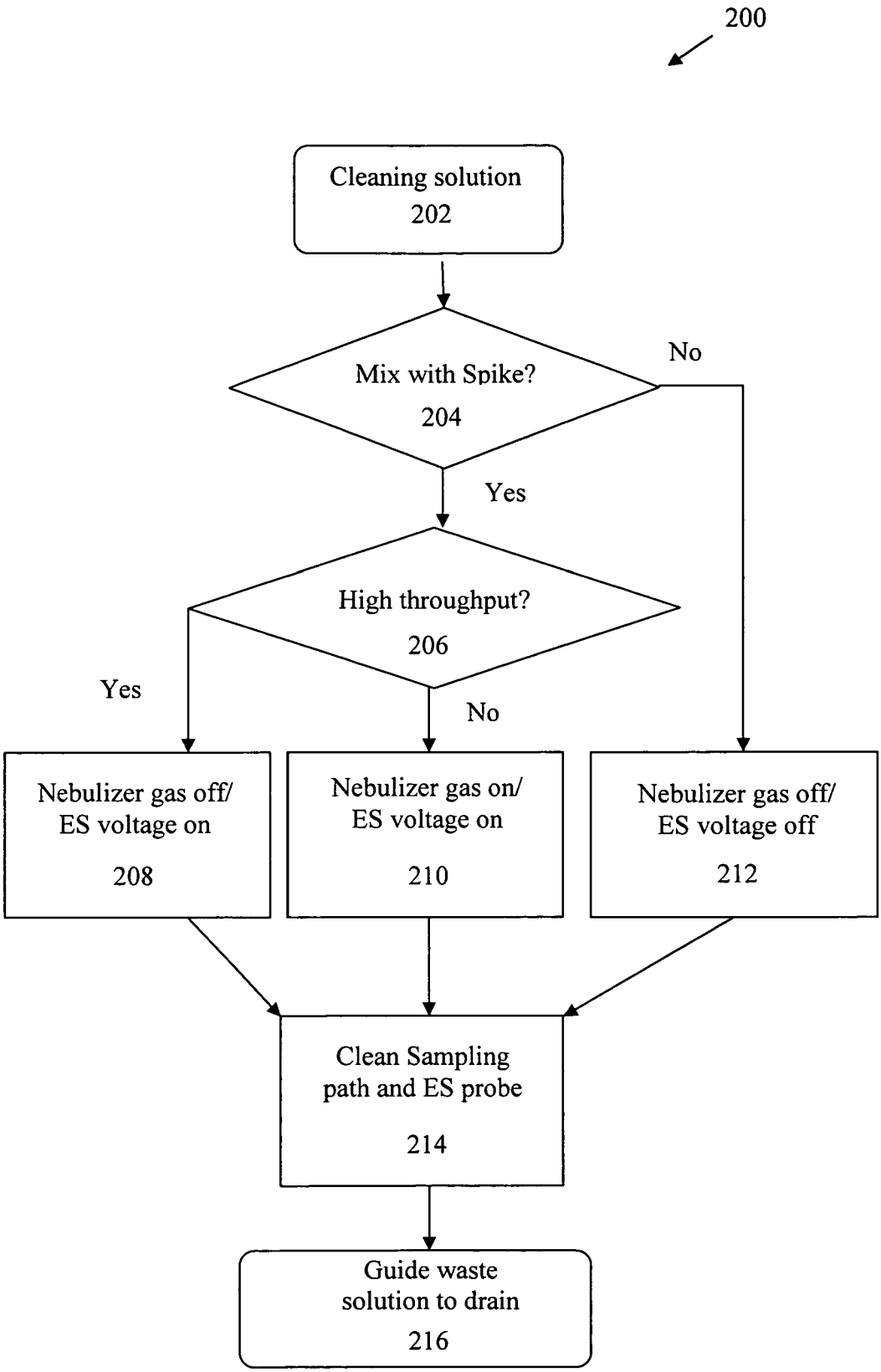
FIG. 2 shows a flowchart of a method for automatic reconditioning and cleaning of a sampling pathway with an electrospray probe or nebulizer of an inline electrospray ionization mass spectrometer in accordance with an embodiment of the present invention.

Referring now to FIG. 2 in conjunction with FIG. 1, a flowchart is shown of a method 200 for inline reconditioning and cleaning of an electrospray probe or nebulizer (in one example being part of an inline electrospray ionization mass spectrometer apparatus) and/or sampling pathway in accordance with an embodiment of the present invention.

At step 202, a cleaning solution is provided from a cleaning solution source 108, which may be a reservoir of some type. At step 204, a decision block is presented as to whether the cleaning solution should be mixed with a spike. If yes, the method moves to step 206. If no, the method moves to step 212.

At step 206, for the method in which the cleaning solution is to be mixed with a spike, a subsequent decision block is presented as to whether high throughput is desired or not. If yes, the method moves to step 208. If no, the method moves to step 210. In either case, cleaning solution from cleaning solution source 108 and spike from spike source 104 are delivered to be mixed, in one example being mixed in mixture reservoir 110 and in another example being mixed inline such as via a mixing-T. As can be seen, the spiked cleaning solution may be introduced to the ES probe and/or sample pathway in various ways as shown by steps 208 and 210.

At step 208, for the method in which high throughput is desired, nebulizer gas is turned off and ES voltage is turned on. The ES high voltage (e.g., by switching on) and/or nebulizer gas (e.g., by turning off) may be manipulated for enhancing the simultaneous reconditioning and cleaning of the ES probe or nebulizer. Alternatively, cleaning with the ES high voltage switched on helps to maintain the equilibrium as in a regular ES process. Cleaning without nebulizer gas (such as nitrogen for ES or nitrogen/oxygen, helium, and/or argon in other cases) allows for the use of a relatively faster flowrate for the spiked cleaning solution (between about 100-500 microliter/minute) for faster cleaning (i.e., higher throughput is possible).

At step 210, for the method in which high throughput is not desired or for some other performance reason, nebulizer gas is turned on and ES voltage is turned on. At step 210, the spiked cleaning solution is introduced while simulating a normal ES process, treating the spiked cleaning solution as a sample. The spiked cleaning solution may be provided manually or automatically from mixture reservoir 110. In such a scenario, high voltage is on, and drying gas and nebulizer gas are flowed. Disadvantageously, flowrate may be relatively slow in this process, for example between about 1-30 microliter/minute.

At step 212, for the cleaning method in which the cleaning solution is not to be mixed with a spike, nebulizer gas is turned off and ES voltage is turned off. Only cleaning solution from cleaning solution source 108 is sent to mixture reservoir 110 and then is sent to solution delivery 120, or in another embodiment, cleaning solution may be sent directly to solution delivery 120 from mixture reservoir 110 or from an inline apparatus such as a mixing-T.

Next, at step 214, the cleaning solution, whether spiked or not, is used to clean the sampling path and/or ES probe or nebulizer.

At step 216, a Teflon guide 138 may be used in the spray chamber 132 for guiding spent or used cleaning solution to a drain 136. The Teflon guide directs waste solution to drain instead of accumulating in the spray chamber.

Another example of a system which may be cleaned and reconditioned (including an example of analyzer portion 134) in accordance with the present invention is disclosed in commonly-assigned U.S. patent application Ser. No. 10/835,492, now U.S. Pat. No. 7,005,635, filed on Apr. 29, 2004, which is incorporated by reference in its entirety.

Embodiments described above illustrate but do not limit the invention. It should also be understood that numerous modifications and variations are possible in accordance with the principles of the present invention. For example, as noted above, various spikes, cleaning solutions, and concentrations may be used. Accordingly, the scope of the invention is defined by the following claims.

I claim:

1. A method for reconditioning and cleaning an inline mass spectrometer, wherein the inline mass spectrometer is configured to receive a solution of a sample having an analyte and a spike related to the analyte through a sampling pathway, the method comprising:

providing a mixture of the spike and a cleaning solution; and cleaning the sampling pathway with the mixture.

2. The method of claim 1, wherein the spike is selected from the group consisting of cation species, anion species, molecular species, isotopically enriched species, and naturally abundant species.

3. The method of claim 1, wherein the spike is selected from the group consisting of bis (2-sulfoethyl) disulfide (SES), $^{65}Cu^{2+}$, $Cl^{-}$, and $^{13}C$-enriched isopropyl alcohol.

4. The method of claim 1, wherein the cleaning solution is comprised of a liquid selected from the group consisting of ultrapure water, acids, bases, organic solvents, and chelating reagents.

5. The method of claim 1, wherein the cleaning solution is comprised of a liquid selected from the group consisting of hydrofluoric acid, nitric acid, acetic acid, ammonium hydroxide, methanol, isoproponal and ethylenediaminetetraacetic acid (EDTA).

6. The method of claim 1, wherein the mixture is provided automatically from a spiked cleaning solution reservoir.

7. The method of claim 1, wherein the spike and the cleaning solution are mixed inline prior to the sampling pathway.

8. The method of claim 1, further comprising guiding the used mixture to a drain.

9. The method of claim 1, wherein the sampling pathway includes a probe.

10. The method of claim 9, wherein the probe is an electrospray ionization probe or a nebulizer.

11. The method of claim 9, wherein a flowrate of the mixture through the probe is between about 1 microliter/minute and about 500 microliter/minute.

12. The method of claim 9, further comprising switching on an electrospray voltage prior to cleaning the probe.

13. The method of claim 9, further comprising switching off a nebulizer gas prior to cleaning the probe.

14. The method of claim 9, further comprising flowing a spiked sample after cleaning the probe with the mixture.

15. The method of claim 14, wherein the spiked sample includes a spike which is the same as the spike of the cleaning solution.

16. The method of claim 14, wherein the spiked sample includes a spike which is different from the spike of the cleaning solution.

17. The method of claim 9, further comprising simultaneously analyzing a second sample via a second probe while cleaning a first probe with the mixture.

18. A method for automatically reconditioning and cleaning a sampling pathway with an electrospray probe of an inline electrospray ionization mass spectrometer apparatus, spectrometer, wherein the inline mass spectrometer is configured to receive a solution of a sample having an analyte and a spike related to the analyte through the sampling pathway, the method comprising:

providing a mixture of the spike and an electrospray cleaning solution;

switching on an electrospray voltage;

switching off a nebulizer gas;

cleaning the electrospray probe with the mixture; and guiding the used mixture to a drain.

19. The method of claim 18, wherein the spike is selected from the group consisting of bis (2-sulfoethyl) disulfide (SES), $^{65}Cu^{2+}$, $Cl^{-}$, and $^{13}$-enriched isopropyl alcohol.

20. The method of claim 18, wherein the cleaning solution is comprised of a liquid selected from the group consisting of hydrofluoric acid, nitric acid, acetic acid, ammonium hydroxide, methanol, isoproponal and ethylenediaminetetraacetic acid (EDTA).

21. The method of claim 18, wherein a flowrate of the mixture through the electrospray probe is between about 1 microliter/minute and about 500 microliter/minute.

22. The method of claim 18, further comprising simultaneously analyzing a second sample via a second probe while cleaning a first probe with the mixture.

23. A mass spectrometer system for analyzing a chemical solution or gas, wherein the mass spectrometer is configured to receive a solution of a sample having an analyte and a spike related to the analyte through, a sampling pathway, comprising:

a reservoir holding a mixture of a cleaning solution and the spike;

a solution delivery system operably coupled to the reservoir;

a probe operably coupled to the solution delivery system; and an ion detection module operably coupled to the probe.

24. The system of claim 23, wherein the spike is selected from the group consisting of bis (2-sulfoethyl) disulfide (SES), $^{65}Cu^{2+}$, $Cl^{-}$, and $^{13}$C-enriched isopropyl alcohol.

25. The system of claim 23, wherein the cleaning solution is comprised of a liquid selected from the group consisting of hydrofluoric acid, nitric acid, acetic acid, ammonium hydroxide, methanol, and ethylenediaminetetraacetic acid (EDTA).

26. The system of claim 23, further comprising a guide for guiding the used mixture to a drain.

27. The system of claim 23, wherein the probe is an electrospray ionization probe or a nebulizer.

28. A mass spectrometer system for analyzing a chemical solution or gas spectrometer, wherein the mass spectrometer is configured to receive a solution of a sample having an analyte and a spike related to the analyte through a sampling pathway, comprising:

a cleaning solution source;

a spike source;

a solution delivery system operably coupled to the cleaning solution source and the spike source;

a probe operably coupled to the solution delivery system, wherein the solution delivery system is configured to deliver a mixture of the cleaning solution and the spike through the probe; and an ion detection module operably coupled to the probe.

29. The system of claim 28, wherein the spike is selected from the group consisting of bis (2-sulfoethyl) disulfide (SES), $^{65}Cu^{2+}$, $Cl^{-}$, and $^{13}$C-enriched isopropyl alcohol.

30. The system of claim 28, wherein the cleaning solution is comprised of a liquid selected from the group consisting of hydrofluoric acid, nitric acid, acetic acid, ammonium hydroxide, methanol, and ethylenediaminetetraacetic acid (EDTA).

31. The system of claim 28, wherein the probe is an electrospray ionization probe or a nebulizer.

* * * * *